United States Patent [19]

Nguyen

[11] Patent Number: 4,994,124

[45] Date of Patent: Feb. 19, 1991

[54] SENSITIZED EXPLOSIVE

[75] Inventor: Anh D. Nguyen, Brossard, Canada

[73] Assignee: ICI Canada Inc., North York, Canada

[21] Appl. No.: 523,563

[22] Filed: May 15, 1990

[51] Int. Cl.[5] ..... C06G 45/00

[52] U.S. Cl. ..... 149/21; 149/2; 149/89; 149/105; 149/110; 149/109.6; 149/112

[58] Field of Search ..... 149/112, 2, 21, 109.6, 149/89, 105, 110

[56] References Cited

U.S. PATENT DOCUMENTS

| | | | |
|---|---|---|---|
| 4,545,829 | 10/1985 | Starkenberg et al. | 149/109 |
| 4,548,659 | 10/1985 | Jessop | 149/18 |
| 4,566,919 | 1/1986 | Jessop | 149/20 |
| 4,600,450 | 7/1986 | Jessop et al. | 149/19.3 |
| 4,600,451 | 7/1986 | Jessop et al. | 149/19.3 |
| 4,600,452 | 7/1986 | Jessop et al. | 149/19.3 |
| 4,710,248 | 12/1987 | Yates et al. | 149/2 |
| 4,718,953 | 1/1988 | Nguyen et al. | 149/17 |
| 4,722,757 | 2/1988 | Cooper et al. | 149/2 |

*Primary Examiner*—Stephen J. Lechert, Jr.
*Attorney, Agent, or Firm*—C. Brian Barlow

[57] ABSTRACT

A chemically sensitized dry explosive is provided, which can be used as a blasting agent, per se, or can be used in the production of a wide variety of explosive compositions. The compositions are typically manufactured from an unstable emulsion explosive and have a chemical sensitizer in either the continuous or discontinuous phase. The compositions are characterized in that they comprise 5 to 30% water in the discontinuous phase after crystallization of the composition.

14 Claims, No Drawings

SENSITIZED EXPLOSIVE

This invention relates to high explosives, and in particular, to an explosive sensitizer to be used as a blasting agent, per se, or used as a sensitizing agent.

A wide range of explosives for commercial blasting are currently available in a variety of densities, strengths, sensitivities, physical forms and prices. Recent developments in the production and use of ammonium nitrate-fuel oil (ANFO) emulsion and slurry explosives have, to a large degree, resulted in the replacement of more traditional explosives. However, still in current use in the industry, are the conventional "stick-type" explosives, containing nitroglycerin (NG) or ethylene glycol dinitrate (EGD) as sensitizers. The stick-type explosives maintain their commercial utility because of their high strength, reliability, sensitivity, and competitive cost.

The disadvantages of the stick-type explosives lies in the hazardous nature of the NG or EGD ingredient and the health hazard associated with the vapors given off by these sensitizers. It would be desirable, therefore, if a low cost, safe and non-toxic substitute sensitizer could be found for NG or EGD which substitute sensitizer might also be of use in a wide range of explosive types.

Various attempts have been made to provide a dry, particulate, low cost explosive, suitable for use as a blasting agent, per se, or as a sensitizing agent of use in the manufacture of a broad range of explosive compositions and which avoid the use of NG or EGD.

Starkenberg et al., in U.S. Pat. No. 4,545,829 describe an emulsion synthesized composite high explosive which is prepared by crystallizing an emulsion of ammonium nitrate in a molten mixture of a surfactant and trinitrotoluene (TNT). Alternatively, the TNT can mixed in an aqueous solution of ammonium nitrate, the mixture homogenized, and the resultant mixture spray dried to remove the water.

In U.S. Pat. Nos. 4,548,659 and 4,566,919, Jessop describes a cast emulsion explosive composition, wherein an emulsion explosive comprising less than about 5% water, is prepared having an emulsifier which allows the emulsion to form and crystallize to produce a cast composition.

Further, in U.S. Pat. Nos. 4,600,450, 4,600,451, and 4,600,452, Jessop et al, describe a "microknit" composite explosive prepared from a molten-nitrate containing emulsion explosive comprising less than 3% water.

All of the emulsions described in the patents referred to hereinabove comprise less than 5% water. This limitation results in increased difficulty in the preparation of the dry explosive in that either a melt processing technique is used whereby dry ammonium nitrate is emulsified into a molten TNT mixture, or, a low water emulsion is prepared. Both the "melt" and the low water emulsion compositions have been found to provide suitably sensitive materials for blasting, and as sensitizers. However, these materials must be manufactured at high temperatures in order to melt the oxidizer salt or to make a low water content aqueous solution. At these high temperatures, the emulsion explosive mixture is increasingly more shock sensitive. Further, after production, the dry sensitized explosives are sensitive to friction and low impact which makes processing the final dry product difficult and/or hazardous.

Surprisingly, we have now found that high explosive products can be prepared from water-in-oil emulsion explosives by crystallizing said emulsions, wherein the crystallized oxidizer phase comprises 5 to 30% water by weight, of the weight of the total composition, which avoids many of the problems associated with the prior art.

It is an object of the present invention to provide a high strength explosive.

It is a further object of the present invention to provide a particulate or cast explosive that is prepared from an emulsion explosive.

It is still a further object of the present invention to provide a explosive which can be utilized in place of NG and EGD based explosive compositions.

Accordingly, the present invention provides a sensitized, water resistant, particulate explosive composition comprising a crystallized oxidizer salt, and a sensitizing amount of a chemical sensitizer, wherein said crystallized oxidizer salt comprises 5 to 30% water by weight of the weight of the total composition.

The particulate explosive composition, according to the present invention, is preferably prepared by crystallization of an emulsion explosive, which method of preparation is set out hereinbelow.

During preparation of the particulate explosive of the present invention, the chemical sensitizer can be part of either the aqueous discontinuous phase or the continuous phase of the emulsion. Further, the chemical sensitizer can be the sole component of the continuous phase. For example, the chemical sensitizer may be TNT into which an aqueous solution of nitrate salts can be dispersed. The continuous phase of the emulsion used to prepare the explosive composition may, therefore, be a chemical sensitizer alone, a mixture of a chemical sensitizer and a fuel, or, in the situation where the chemical sensitizer is in the aqueous discontinuous phase, can be a fuel alone.

The phase "sensitizing amount" as used hereinabove, means an amount of sensitizer which will make the particulate explosive capable of detonation.

Different chemical sensitizers can be used in combination, and may be added to either, or both, of the continuous and discontinuous phases of the emulsion.

Chemical sensitizers which may be added to the aqueous discontinuous phase of the emulsion include sodium perchlorate, ethylene diamine dinitrate, methyl amine nitrate, ethanolamine nitrate, or mixtures thereof.

When added to the continuous phase, the chemical sensitizer may be, for example, trinitrotoluene or nitromethane.

Preferred fuels include mineral oil, waxes, paraffin oils, benzene, toluene, xylenes, and mixtures of liquifiable hydrocarbons, such as for example, petroleum distillates such as gasoline, kerosene and diesel fuel.

Suitable oxidizer salts are oxygen containing salts, such as, for example, nitrates, chlorates, and perchlorates, wherein the oxygen is used in the explosive reaction. These oxidizer salts include ammonium nitrate, sodium nitrate, calcium nitrate, potassium nitrate, or mixtures thereof. Preferably, the oxidizer salt is ammonium nitrate.

The water content of the oxidizer phase of the particulate explosive, after crystallization, is 5 to 30% by weight of the total weight of the composition. Preferably, the water content is between 8 and 15% by weight, and more preferably between 10 and 12% by weight, in order to ensure that the processing temperature is below 95° C. and to ensure a good sensitivity in the resulting crystallized salt.

The emulsion explosive route for the preparation of the explosives of the present invention allows thorough and intimate mixing of the oxidizer salt discontinuous phase and the continuous phase. By the proper selection of surfactants and mixing equipment, one skilled in the art may easily be able to obtain emulsions, and thus a particulate explosive composition wherein the crystallized oxidizer salt has an average particle size of less than 5 microns, and preferably between 0.5 and 5 microns.

The sensitivity of the particulate explosive is influenced by the density of the product when used. The density is, in part, determined by the voids, or air spaces, formed between particles when the particles are packed or cartridged. The sensitivity can be further controlled by the addition of glass microballoons, as is known in the art, to the emulsion, prior to crystallization.

Control of the sensitivity of the composition by the use of microballoons, for example, also allows the same emulsion to be used to prepare a cast explosive, wherein the emulsion is poured into a mold and allowed to crystallize in the shape of the mold.

In a second aspect, the present invention provides a method of producing an explosive composition. When the chemical sensitizer is to be used as the continuous phase, the method of producing an explosive composition comprises:

mixing an aqueous oxidizer salt phase comprising 5 to 30% water by weight of the weight of the total composition, in a heated, water immiscible, chemical sensitizer phase such that said aqueous phase forms a discontinuous phase, and said water immiscible phase forms a continuous phase, and thus generates a phase unstable emulsion explosive; and cooling said emulsion explosive so that said emulsion explosive crystallizes.

The water immiscible continuous phase may also comprise a fuel.

Alternatively, in a composition where the chemical sensitizer is located in the aqueous discontinuous phase, the present invention also provides a method of producing an explosive composition comprising:

mixing an aqueous mixture of a chemical sensitizer and an oxidizer salt phase comprising 5 to 30% water by weight of the weight of the total composition, in a heated water immiscible fuel phase such that said aqueous phase forms a discontinuous phase, and said water immiscible fuel phase forms a continuous phase, and thus generate an unstable emulsion explosive; and cooling said emulsion explosive so that said emulsion explosive crystallizes.

One skilled in the art of the preparation of emulsion explosives will be aware that the emulsion can be prepared by thorough mixing, such as with a homogenizer, or through the use of suitable surfactants. Suitable surfactants will allow the emulsion to be prepared, but will also allow crystallization to take place when the emulsion is cooled. For example, suitable surfactants include the polyisobutylene succinic anhydride (PIBSA) based surfactants as described in Canadian Patent No. 1,244,463.

The invention is further illustrated, without limitation on the scope of the invention, by the following examples In the examples, all percentages are expressed as weight by weight.

EXAMPLE 1

TNT Sensitized Nitrate Salts

A water-in-oil (w/o) emulsion was prepared according to the composition as set out in Table IA by first melting the TNT in a 5 liter steam-jacketted Hobart* mixer bowl at a temperature of 90 to 105° C. The surfactants, E-476 (a PIBSA based surfactant prepared by reacting a 1 to 1 molar ratio of polyisobutylene succinic anhydride and diethanolamine) and Arlacel TM C (a sorbitan sesquioleate surfactant), were added and mixed into the TNT. A liquor of 77% ammonium nitrate (AN), 11% sodium nitrate (SN) and 12% water, at a temperature of 90° C. was slowly added to the TNT/surfactant mixture while mixing with a whisk shaped mixer at 285 r.p.m. (Speed 2 of the Hobart mixer). A poor w/o emulsion was formed which crystallized on cooling to room temperature.

TABLE 1A

| Ingredient | % Added | % of Composition |
|---|---|---|
| E-476 | 0.5 | 0.5 |
| Arlacel C | 0.5 | 0.5 |
| TNT | 12.0 | 12.0 |
| AN/SN Liquor | 87.0 | — |
| AN | — | 67.0 |
| SN | — | 9.6 |
| Water | — | 10.4 |
| | 100.0 | 100.0 |

The crystallized emulsion was broken into relatively dry, free-flowing particles with a rubber spatula. A microscopic examination showed the particles to be formed of an intimate mixture of crystals or fine granules of oxidizer salt having a grain size in the range of 1 to 2 microns. The inter-granule spaces were seen to be occupied by solidified TNT.

The particles were cartridged into plastic tubes of various diameters, for testing, at a density of about 0.85 g/cc. The various tubes were initiated by an R-6 cap (0.15 g PETN base charge) and the velocity of detonation (VOD) was measured The VOD results are shown in Table 1B.

TABLE 1B

| Tube Size (mm) | VOD (m/sec) |
|---|---|
| 25 | 2673 |
| 32 | 2994 |
| 50 | 2994 |
| 63 | 3076 |
| 70 | 3311 |

The crystallized emulsion at a full density, i.e. before being broken up into free flowing particles, of 1.45 g/cc failed to detonate even with a 250 g primer.

In the following examples, the experimental procedures were similar to the procedures used in Example 1. In general, the oil phase consisting of surfactants, oils, waxes, and/or water insoluble chemical sensitizers were weighed in the Hobart mixing bowl. The mixtures were heated by steam to 50° to 90° C. with constant stirring with a whisk shaped mixer at 285 r.p.m. (Speed 2 of the mixer).

The aqueous phase, comprising ammonium nitrate, sodium nitrate, water soluble sensitizers and water, was prepared separately. The aqueous mixture was heated in a water bath with constant stirring until all salts were dissolved. The fudging temperature of the aqueous phases employed in these examples was in the range of 65° to 80° C. Unless otherwise noted, in the examples, the term AN/SN Liquor refers to a 77% ammonium nitrate, 11% sodium nitrate, and 12% water mixture.

The aqueous phase, at a temperature of 90° C. was added slowly to the heated oil phase in the mixing bowl while being constantly stirred. A water-in-oil emulsion was formed. The emulsions exhibited normal transparent and viscous properties.

After manufacture, the emulsion was spread to a thin layer of about 5 mm thick and allowed to cool to ambient temperature. When its temperature reached about 40° C., the emulsion began to crystallize into a white, opaque, stiff and non-sticky salt. The salt was crushed into particles of 1 to 3 mm in size by a rubber roller. The resulting particles were packaged, with or without tamping, in different sizes for testing.

EXAMPLE 2

Nitrate Salts Sensitized by Chemical Sensitizers in the External Phase

Table 2 shows the composition of nitrate salts prepared with TNT or nitromethane in the oil phase as a chemical sensitizer.

TABLE 2

| | Composition No. 1 (Example 1) | 2 |
|---|---|---|
| Ingredient (%) | | |
| E-476 | 0.5 | 0.5 |
| Arlacel C | 0.5 | 0.5 |
| TNT | 12.0 | — |
| Nitromethane | — | 12.0 |
| AN/SN Liquor | 87.0 | 87.0 |
| Density (g/cc) | 0.85 | 0.85 |
| VOD (m/sec) - EB cap in 63 mm diameter | 3076 | 2427 |

AN/SN Liquor: 77% AN/11% SN/12% water
EB Cap: 0.78 g PETN base charge
Density: Density of the cartridged powder Both the TNT and nitromethane sensitized nitrate salts were cap sensitive with a satisfactory detonation velocity at the cartridged bulk density of 0.85 g/cc.

EXAMPLE 3

Effect of TNT on Sensitivity

Table 3 shows the detonation velocity of TNT sensitized nitrates with the TNT level varying from 3 to 19%.

TABLE 3

| | Composition No. 3 | 4 | 5 | 6 |
|---|---|---|---|---|
| Ingredient (%) | | | | |
| E-476 | 0.5 | 0.5 | 0.5 | 0.5 |
| Arlacel C | 0.5 | 0.5 | 0.5 | 0.5 |
| TNT | 3.0 | 6.0 | 12.0 | 19.0 |
| AN/SN Liquor | 96.0 | 93.0 | 87.0 | 80.0 |
| Density (g/cc) | 0.85 | 0.85 | 0.85 | 0.85 |
| VOD (m/sec) - EB cap | | | | |
| in 25 mm diameter | Failed | Failed | 2994 | 1515 |
| in 32 mm diameter | Failed | Failed | 2673 | 1901 |
| in 50 mm diameter | Failed | 235 | 2994 | 2550 |
| in 63 mm diameter | Failed | 2190 | 3076 | 3082 |
| in 70 mm diameter | Failed | 2424 | 3311 | 2940 |
| After 5 months in 70 mm diameter | Failed | 2442 | 2995 | 3190 |

These result indicate that, in this formulation, 3% TNT is insufficient to sensitize explosive compositions in these diameters. At 6%, the sensitized nitrate salts were cap sensitive at 63 mm or above in diameter. The formulations appeared to be most sensitive when 12% TNT was used.

The samples retained the same sensitivity after 5 months in storage, indicating that the sensitivity of the sensitized nitrate salts does not depend on residual non-crystallized emulsion.

EXAMPLE 4

Cap Sensitivity of TNT Sensitized Nitrates

Table 4 shows the cap sensitivity of TNT sensitized nitrates at different densities.

TABLE 4

| Density | TNT Sens. Nitrate* | Wood Pulp | Min. Primer (25 mm) | VOD (m/sec) (25 mm) |
|---|---|---|---|---|
| 0.90 | 90.0 | 10.0 | R-6** | 2602 |
| 1.07 | 95.0 | 5.0 | R-6 | 2481 |
| 1.14 | 98.0 | 2.0 | EB | 577 |
| 1.18 | 100.0 | 0.0 | EB | Failed |

*TNT sensitized nitrate of Composition No. 5
**R-6 Cap: 0.15 g PETN base charge

The samples were prepared by mixing the crushed particles with wood pulp and tamping the mixtures into 25 mm cartridges on a Hall machine.

The results show that the TNT sensitized nitrates were adequately sensitive (R-6) at densities below 1.10 g/cc in 25 mm diameter cartridges. Therefore, the sensitized nitrates could be used in small diameter, cap sensitive explosives.

EXAMPLE 5

Effect of Surfactants on TNT Sensitized Nitrates

Table 5 shows a variety of surfactants which were employed during emulsification in the process of making sensitized nitrate salts.

TABLE 5

| | Composition No. 7 | 8 | 9 | 10 | 11 |
|---|---|---|---|---|---|
| Ingredient (%) | | | | | |
| Sorbitan Mono-oleate | 1.0 | — | — | — | — |
| Sorbitan Sesquioleate | — | 1.0 | — | — | — |
| Sorbitan Trioleate | — | — | 1.0 | — | — |
| Sorbitan Monostearate | — | — | — | 1.0 | — |
| PIB Alkyl Phenol | — | — | — | — | 1.0 |
| TNT | 6.0 | 6.0 | 6.0 | 6.0 | 6.0 |
| AN/SN Liquor | 93.0 | 93.0 | 93.0 | 93.0 | 93.0 |
| Emulsification | Yes | Yes | No | No | Yes |
| VOD (m/sec) - EB cap in 63 mm diameter | 2190 | 2306 | — | — | 3292 |

PIB Alkyl Phenol: Polyisobutylene alkyl phenol

The surfactant level of 1% was selected to determine if a proper emulsion would form at a processing temperature of 90° C. and under the processing conditions given hereinabove. Normal oil-in-water emulsions were formed in Compositions 7, 8, and 11 which crystallized immediately upon cooling. In compositions 9 and 10, emulsions did not form completely, which resulted in the formation of two separated phases when cooled.

The selection of suitable surfactants can be determined by experimentation, as those surfactants which will, at least, form an emulsion during processing.

EXAMPLE 6

Factors Affecting the Sensitivity of TNT Sensitized Nitrates

Table 6 shows the effect of paraffin oil and air bubbles on the sensitivity of TNT sensitized nitrates.

TABLE 6

| | Composition No. | | |
|---|---|---|---|
| | 13 | 14 | 15 |
| Ingredient (%) | | | |
| E-476 | 0.5 | 0.5 | 0.5 |
| Arlacel C | 0.5 | 0.5 | 0.5 |
| TNT | 12.0 | 12.0 | 12.0 |
| HT-22 Paraffin Oil | 1.8 | — | — |
| AN/SN Liquor | 85.2 | 85.0 | 86.5 |
| B23 microballoons | — | 2.0 | — |
| Sodium Nitrite* | — | — | 0.5 |
| Density (g/cc) | 0.85 | 0.65 | 0.70 |
| VOD (m/sec) - EB cap in 63 mm diameter | Failed | 2881 | 3307 |

*added as a 20% solution in water

Composition 13 was similar to composition 5 with 1.8% paraffin oil added to the oil phase. The resulting TNT sensitized nitrate was not cap sensitive. Compositions 14 and 15 were TNT sensitized nitrate containing voids either as glass microballoons or by sodium nitrite gassing. Both samples were reduced in density but still retained their cap sensitivity.

Therefore, it is apparent, that the additional paraffin oil had a desensitizing effect on the sensitized nitrates, so that additional chemical sensitizer would be required for this formulation, and that voids could reduce the density of the TNT sensitized nitrates without affecting the sensitivity of the composition.

EXAMPLE 7

Comparison of TNT Sensitized Nitrates to Other Systems

Table 7 illustrates the differences between TNT sensitized nitrates and TNT emulsions, and other non-sensitized nitrate salts.

TABLE 7

| | Composition No. | | | |
|---|---|---|---|---|
| | 16 | 17 | 18 | 19 |
| Ingredient (%) | | | | |
| E-476 | 2.0 | 2.0 | — | 0.3 |
| Arlacel C | 0.5 | 0.5 | 0.3 | 0.3 |
| TNT | 12.0 | 12.0 | — | — |
| Paraffin Wax | — | — | 4.0 | — |
| Toluene | — | — | — | 4.0 |
| AN/SN Liquor | 85.0 | 85.5 | 95.7 | 95.4 |
| B23 microballoons | 0.5 | — | — | — |
| Density (g/cc) | 1.41 | 1.45 | 0.85 | 0.85 |
| M.P. VOD (m/sec) | EB-Failed | EB-Failed | EB-Failed | EB-Failed |
| in 75 mm diameter | 20 g*-913 | 20 g*-1046 | — | — |
| | 125 g*-3377 | 125 g*-1189 | — | — |
| | — | 250 g*-710 | — | — |

M.P.: minimum primer needed for detonation
*Pentolite booster

Compositions 16 and 17 were stable, non-crystallized emulsion explosives, when cooled, with TNT as the external phase. With microballoons, and a density of 1.41 g/cc as in composition 16, the emulsion was marginally sensitive with a 125g Pentolite booster. Without microballoons, as in composition 17, and a density of 1.45 g/cc, the emulsion merely burned.

Composition 18 was a crystallized nitrate salt made from a conventional oil/wax emulsion. Such nitrate salt failed to be cap-sensitive when completely crystallized.

Composition !9 was a similar crystallized nitrate salt made with toluene as the external phase. Such nitrate salt was not cap sensitive due to the non-energetic nature of the external phase.

Thus, the TNT sensitized, crystallized nitrate is different from conventional emulsion explosives, and the sensitivity of the sensitized nitrate is derived from the chemical (TNT) sensitizer.

EXAMPLE 8

Nitroalkane Sensitized Nitrate Salts

Composition 2 in Example 2 demonstrated that 12% nitromethane was sufficient sensitizer in the chemically sensitized nitrate to provide suitable properties. Compositions 20 and 21 in Table 8 were made with 10% nitromethane or nitroethane. Both of the resulting salts failed to detonate, even with 25 g of Pentolite.

TABLE 8

| | Composition No. | |
|---|---|---|
| | 20 | 21 |
| Ingredient (%) | | |
| B-476 | 0.5 | 0.5 |
| Arlacel C | 0.5 | 0.5 |
| Nitromethane | 10.0 | — |
| Nitroethane | — | 10.0 |
| AN/SN Liquor | 89.0 | 89.0 |
| Density (g/cc) | 0.85 | 0.85 |
| M.P. in 70 mm diameter | | |
| EB | Failed | Failed |
| 25 g Pentolite | Failed | Failed |

The results, from Example 2 and Example 8, indicate that although it is possible to produce sensitized nitrates with nitroalkanes, they were not as sensitive as TNT sensitized nitrates.

EXAMPLE 9

Nitrate Salts Sensitized by Chemical Sensitizers in the Aqueous Phase

In Examples 1 to 8, the properties of sensitized nitrate salts with water insoluble chemical sensitizers in the continuous (or external) phase have been demonstrated. In this example, and Example 10, the chemical sensitizer is added to the discontinuous aqueous (or internal phase.

Table 9 illustrates the results obtained.

TABLE 9

| | Composition No. 22 | 23 |
|---|---|---|
| Ingredient (%) | | |
| Arlacel C | 0.3 | 0.3 |
| Microcrystalline Wax | 1.0 | 1.0 |
| Paraffin Wax | 2.0 | 2.0 |
| Ammonium Nitrate | 79.3 | 77.0 |
| Sodium Perchlorate | 4.3 | 9.9 |
| Water | 13.1 | 9.8 |
| Density (g/cc) | 1.10 | 1.12 |
| VOD (m/sec) - EB cap | | |
| in 25 mm diameter | Failed | Failed |
| in 32 mm diameter | 1978 | 1991 |
| in 50 mm diameter | 2646 | 2540 |
| in 63 mm diameter | 2995 | 3128 |
| M.P. in 32 mm diameter | R-6 | R-6 |

The aqueous phase was composed of ammonium nitrate, water and with sodium perchlorate as sensitizer. The oil phase contained the surfactant, and waxes. The combination of microcrystalline wax and paraffin wax was chosen to make the final salt non-tacky and hard for easy handling. Since the waxes are easier to emulsify to a temporarily stable w/o emulsion than TNT or nitroalkane, only sorbitan sesquioleate was needed as an emulsifier.

The salts were tested as particles with a size of 5 Mesh (greater than 1.37 mm).

The sodium perchlorate sensitized nitrate salts had satisfactory sensitivity, and there was little observable difference between the 4.3% level and the 9.9% level.

EXAMPLE 10

Amine Nitrate Sensitized Nitrates

Table 10 illustrates the use of ethylene diamine dinitrate (EDDN), methyl amine nitrate (MAN), and ethanolamine nitrate (EAN) as sensitizer in the aqueous phase.

TABLE 10

| | Composition No. 24 | 25 | 26 |
|---|---|---|---|
| Ingredient (%) | | | |
| Arlacel C | 0.3 | 0.3 | 0.3 |
| Microcrystalline Wax | 1.0 | 1.0 | 1.0 |
| Paraffin Wax | 2.0 | 2.0 | 2.0 |
| Ammonium Nitrate | 72.5 | 72.5 | 72.5 |
| EDDN | 9.6 | — | — |
| MAN | — | 9.6 | — |
| EAN | — | — | 9.6 |
| Water | 14.6 | 14.6 | 14.6 |
| Density (g/cc) | 0.9 | 0.9 | 0.9 |
| VOD (m/sec) - EB cap | | | |
| in 32 mm diameter | 2662 | Failed | Failed |
| in 50 mm diameter | 3396 | Failed | Failed |

TABLE 10-continued

| | Composition No. 24 | 25 | 26 |
|---|---|---|---|
| in 70 mm diameter | 2797 | Failed | Failed |

At the 9.6% level, it was found that only the EDDN sensitized salt was cap sensitive. The results indicate that the sensitivity of the composition is dependent on the sensitivity of the chemical sensitizer used.

EXAMPLE 11

Water Resistance and Impact Sensitivity

The water resistance and impact sensitivity of variety of sensitized nitrates were tested. The nitrates selected for testing were compositions No. 5 (TNT sensitized), No. 23 (Sodium Perchlorate sensitized), and No. 24 (EDDN sensitized). Table 11 illustrates the test results.

TABLE 11

| | Composition No. 5 | 23 | 24 |
|---|---|---|---|
| Water Resistance(1) % Dissolved After: | | | |
| 1 hr. | 10.9 | 5.90 | 2.76 |
| 5 hrs. | 11.5 | 6.32 | 3.80 |
| 24 hrs. | 15.8 | 9.36 | 38.12 |
| Impact Sensitivity(2) | | | |
| 5 kg weight, steel on steel | +200 cm | +200 cm | +200 cm |

(1)Water resistance test: 250 g of nitrate salt was poured into 500 ml of water at room temperature. 10 g aliquots were taken after 1, 5, and 24 hours. The water in each aliquot was evaporated at 105° C. and the dissolved salt was measured by weight.
(2)Impact Sensitivity test: A 5 kg weight was dropped on about 0.1 g of sensitized salt. The salts were sandwiched between two 0.5 cm. thick steel discs of 1 cm. diameter. Any indication of detonation of the salt was recorded.

The results indicate that the sensitized nitrate salts are highly resistant to water. By comparison, ammonium nitrate, in a similar test, dissolves completely.

The sensitized nitrate salts are also not highly impact sensitive. For comparison, Amatol (80% AN, 20% TNT) has a drop height of 23 cm.

EXAMPLE 12

Cast Nitrate Explosives

The compositions of the present invention may also be utilized as cast explosives by allowing the emulsion to crystallize in a shaped mold. The sensitivity of the cast compositions can be controlled by adjusting the density of the cast material. The addition of microballoons or a gassing solution are convenient methods for density control.

Table 12 illustrates a number of cast explosives which were prepared and tested.

TABLE 12

| | Composition No. 27 | 28 | 29 | 30 | 31 | 32 |
|---|---|---|---|---|---|---|
| Ingredient (%) | | | | | | |
| E-476 | — | — | — | 0.5 | 0.5 | — |
| Arlacel C | 0.3 | 0.3 | 0.3 | 0.5 | 0.5 | 0.3 |
| HT-22 | 4.0 | 4.0 | 4.0 | — | — | 4.0 |
| TNT | — | — | — | 12.0 | 12.0 | — |
| AN | 72.5 | 72.9 | 72.6 | 63.2 | 64.7 | — |
| SN | 10.4 | 10.4 | — | 9.0 | 9.2 | — |
| Sodium Perchlorate | — | — | 8.7 | — | — | 63.5 |
| Water | 11.3 | 11.4 | 9.4 | 9.8 | 10.1 | 27.2 |
| Gassing Solution | 1.5 | 1.0 | — | — | — | — |

TABLE 12-continued

| | Composition No. | | | | | |
|---|---|---|---|---|---|---|
| | 27 | 28 | 29 | 30 | 31 | 32 |
| B23 Microballoons | — | — | 5.0 | 5.0 | 3.0 | 5.0 |
| Density g/cc | 0.86 | 0.91 | 1.12 | 1.12 | 1.20 | 1.12 |
| Minimum Primer | R-9* | — | R-5** | R-9 | R-9 | R-9 |
| VOD (m/sec) in 50 mm diameter | 2749 | Failed | 4922 | 4176 | 4349 | 4704 |

Gassing Solution: A 25% sodium nitrite aqueous solution
*R-9 Cap: 0.30 g PETN base charge
**R-5 Cap: 0.10 g PETN base charge Compositions 27 and 28 were prepared without chemical sensitizers and indicate that without chemical sensitizers, the cast nitrate explosive is only cap sensitive at low densities. This is similar to package ANFO, except that the cast nitrate has better sensitivity and is more water resistant.

Compositions 29 to 32 show cast explosives that have been sensitized by TNT or sodium perchlorate and thus are sensitized by internal and external sensitizers. Composition 30 illustrates a high water content cast explosive.

I claim:

1. A sensitized, water resistant, particulate explosive composition comprising a crystallized oxidizer salt, and a sensitizing amount of a chemical sensitizer, wherein said crystallized oxidizer salt comprises 5 to 30% water by weight of the weight of the total composition.

2. A composition as claimed in claim 1 wherein said crystallized oxidizer salt comprises 8 to 15% water by weight of the weight of the total composition.

3. A composition as claimed in claim 1 wherein said crystallized oxidizer salt comprises 10 to 12% water by weight of the weight of the total composition.

4. A composition as claimed in claim 1 wherein said crystallized oxidizer salt has an average particle size of less than 5 microns.

5. A composition as claimed in claim 1 wherein said composition is cast.

6. A composition as claimed in claim 1 additionally comprising glass microballoons.

7. A composition as claimed in any one of claims 1 to 6 wherein said oxidizer salt is selected from the group consisting of ammonium nitrate, sodium nitrate, calcium nitrate, potassium nitrate, and mixtures thereof.

8. A composition as claimed in any one of claims 1 to 6 wherein said chemical sensitizer is selected from the group consisting of sodium perchlorate, ethylene diamine dinitrate, methyl amine nitrate, ethanolamine nitrate, and mixtures thereof.

9. A composition as claimed in any one of claims 1 to 6 wherein said chemical sensitizer is trinitrotoluene or nitromethane.

10. A composition as claimed in claim 1 additionally comprising a fuel.

11. A composition as claimed in claim 10 wherein said fuel is an oil or a wax.

12. A method of producing an explosive composition comprising:

mixing an aqueous oxidizer salt phase comprising 5 to 30% water by weight of the weight of the total composition, in a heated, water immiscible, chemical sensitizer phase such that said aqueous phase forms a discontinuous phase, and said water immiscible phase forms a continuous phase, and thus generates an unstable emulsion explosive; and cooling said emulsion explosive so that said emulsion explosive solidifies.

13. A method as claimed in claim 12 wherein said immiscible phase additionally comprises a fuel.

14. A method of producing an explosive composition comprising:

mixing an aqueous mixture of a chemical sensitizer and an oxidizer salt phase comprising 5 to 30% water by weight of the weight of the total composition, in a heated water immiscible fuel phase such that said aqueous phase forms a discontinuous phase, and said water immiscible fuel phase forms a continuous phase, and thus generate an unstable emulsion explosive; and cooling said emulsion explosive so that said emulsion explosive solidifies.

* * * * *